United States Patent [19]

Aviram et al.

[11] 4,400,100

[45] Aug. 23, 1983

[54] FOUR LAYERED RIBBON FOR ELECTROTHERMAL PRINTING

[75] Inventors: Ari Aviram, Yorktown Heights, N.Y.; Susan O. Ellmann, Lexington, Ky.

[73] Assignee: International Business Machines Corp., Armonk, N.Y.

[21] Appl. No.: 239,781

[22] Filed: Mar. 2, 1981

[51] Int. Cl.[3] ..... B41J 31/02

[52] U.S. Cl. ..... 400/120; 400/241.1; 156/329; 427/148; 428/412; 428/447; 346/76 R

[58] Field of Search ..... 400/120, 241.1; 346/76 R; 156/329; 427/45.1, 49, 148; 428/391, 405, 412, 429, 447, 450

[56] References Cited

U.S. PATENT DOCUMENTS

| | | | |
|---|---|---|---|
| 3,505,099 | 4/1970 | Neuroth | 428/447 |
| 3,650,808 | 3/1972 | Gagnon | 428/447 |
| 3,744,611 | 7/1973 | Montanari et al. | 400/120 |
| 4,049,867 | 9/1977 | Ito et al. | 428/447 X |
| 4,103,066 | 7/1978 | Brooks et al. | 400/241.1 X |
| 4,126,730 | 11/1978 | Molari, Jr. | 428/450 X |
| 4,291,994 | 9/1981 | Smith et al. | 400/241.1 |
| 4,308,318 | 12/1981 | Weiche | 400/120 X |
| 4,309,117 | 1/1982 | Chang et al. | 400/120 X |
| 4,315,970 | 2/1982 | McGee | 428/447 X |
| 4,317,123 | 2/1982 | Namiki et al. | 428/447 X |

FOREIGN PATENT DOCUMENTS

| | | | |
|---|---|---|---|
| 850419 | 10/1960 | United Kingdom | 428/447 |

*Primary Examiner*—Ernest T. Wright, Jr.
*Attorney, Agent, or Firm*—Joseph G. Walsh

[57] ABSTRACT

Four layer resistive ribbon transfer tapes for use in electrothermic printing devices are fabricated. The tapes are comprised of a substrate having a heat transferable ink on one of its surfaces, and on its opposing surface there is disposed a metal layer. Bonded to the metal layer is a resistive layer. This resistive layer is caused to be bonded to the metal layer by a layer of an alkoxysilane compound therebetween.

8 Claims, 1 Drawing Figure

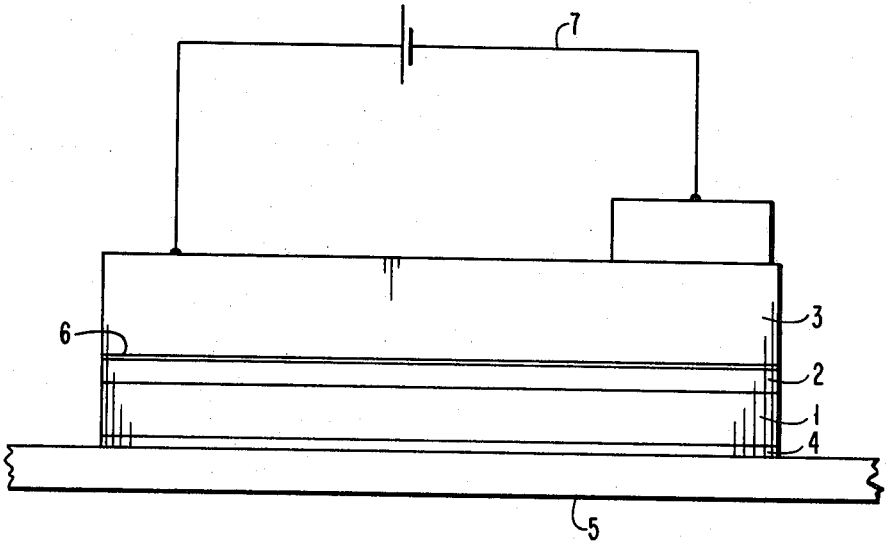
7
6
3
2
1
4
5

FOUR LAYERED RIBBON FOR ELECTROTHERMAL PRINTING

BACKGROUND OF THE INVENTION

1. Field of the Invention

The invention relates to a method for providing an improved four layered resistive ribbon transfer tape, characterized by the step of promoting good adhesion of a resistive layer to a metalized substrate.

2. Prior Art

Electrothermic printing devices are well known in the art. U.S. Pat. No. 3,744,611 to Lucio Montanari et al discloses one such device. An electrothermal printer for non-impact printing on plain paper makes use of a ribbon made up of a substrate having a thermal transferable ink coated on the surface towards the plain paper and a coating of an electrically resistant material on the other side. The ribbon is held in contact with the paper while a plurality of selectively energizable electrodes are held in contact with the resistive material coated side of the ribbon. The electrodes are selectively energized by causing a current to pass through an incremental portion of the resistive material to another electrode which is held in contact with said resistive material a short distance from said selectively energizable electrodes. The current in the incremental portion of the resistive material causes enough $I^2R$ heating to soften the wax coated on the substrate directly opposite to the heated portion. The softened ink transfers to the plain paper sheet as a dot or a line.

The described device uses a three layered ribbon, with an insulating substrate having coated on one of its surfaces a resistive layer and on the opposing surface a thermal transferable ink layer. The disadvantage of this type ribbon is that diffused printing occurs due to lateral spread of the current from the electrode into the plane of the resistive layer.

To overcome the disadvantages of the above mentioned, a three layered resistive ribbon, a four layered ribbon has been devised. This four layered ribbon is comprised of a strength giving substrate layer having coated on one of its surfaces a conducting metal film which has disposed thereon a resistive film. On the opposing surface of said substrate layer is a thermally transferable ink film.

A serious problem incurred during the fabrication of the four layered resistive ribbons is the non-adherence or poor adherence of the resistive layer to the metal film. Separation of the layers often occurs as does corrosion of the conducting film. Thus, good adhesion of the resistive layer to the conducting film is extremely important.

It has been discovered here that the adherence problem is overcome by applying an adhesion promoter selected from among alkoxysilane compounds having the general formulae:

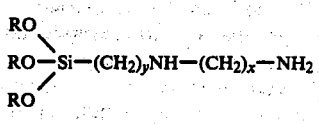

$$\begin{array}{l} RO \\ RO-Si-(CH_2)_yNH-(CH_2)_x-NH_2 \\ RO \end{array}$$

Where R is an alkane group having from 1–5 C atoms. Y is from 1 to 18 carbon atoms and X is from 1 to 18 carbon atoms; and $$(R-O)_3-Si-(CH_2)_n-NH_2$$

Where R is an alkane group having from 1–5 C atoms and n is from 1–18.

SUMMARY OF THE INVENTION

The aforesaid disadvantages are obviated by the device according to the present invention. The steps of preparing the improved resistive ribbon of this invention include (a) providing a metalized substrate, (b) coating the metalized surface of said substrate with an alkoxysilane, (c) baking the above prepared substrate, (d) coating a resistive material onto the metal surface, (e) baking the composite structure and, (f) subsequently coating the opposed surface of said metallized substrate with a thermal transferable ink.

BRIEF DESCRIPTION OF THE DRAWING

The FIGURE shows a cross section of a four layered resistive tape of the invention.

DETAILED DESCRIPTION

In the drawing there is illustrated the resistive ribbon of the invention. The ribbon comprises a substrate layer 1, having on its upper surface a conductive layer 2. Atop conductive layer 2 is a resistive layer 3. On the under surface of the substrate layer 1 is coated thereon a thermally transferable ink 4. A bonding layer of an adhesion promoter is shown at 6. A battery and electrical connections with resistive layer 3 are shown at 7.

In operation a current is applied across layers 3 and 2, to cause heat to occur in layer 3. This heat is transferred through the substrate layer 1 to the thermal transferable ink 4. The ink 4 is caused to melt and is transferred to a paper substrate 5.

In practice the resistive ribbon is fabricated by:

(1) Providing commercially available metalized substrate, which comprises a substrate layer 1 and a conductive layer 2, (2) Coating an adhesion promoter layer 6 selected from an alkoxysilane onto the metal surface 2 of said substrate 1, (3) Baking the so coated substrate 1 at a suitable temperature and for a time sufficient to cause said adhesion promoter layer 6 to adhere to said metal surface 2, (4) Applying a layer of resistive material 3 to the surface of said adhesion promoter layer 6, (5) Baking at a temperature and for a time sufficient to cause said resistive material 3 to adhere to the surface of said adhesion promoter layer 6, and thereafter (6) Coating an ink 4 to the surface of said substrate, which is not metal coated.

The substrate or supporting layer 1 can be fashioned from a material such as mylar, polycarbonate, polysulfone, kapton, kevlar, tedlar, cellophane, stainless steel, aluminum foil etc. The conductive or metal layer 2 can be any metal generally used as electronic conductors such as copper, aluminum and the like. In preferred embodiments aluminum is the metal of choice.

The resistive layer 3 is comprised of graphite filled polycarbonate. In preferred embodiments of the invention the resistive compositions can be prepared from about 75% to about 65% polycarbonate by weight and from about 25% to about 35% of carbon by weight.

Thermally transferable ink 4 is composed of a polymeric material which has a melting point at about 100° C. and a color former. A preferred ink which can be used is one containing a polyamide similar to Versamide 940, prepared by General Mills, and carbon black.

Notable alkoxysilanes which can be used as the adhesion promoter layer 6 are chosen from those having amino and amine groups or an amine group alone attached thereto. For example, 3-(aminoethylamine) propyltrimethoxysilane
3-(2-aminoethylamine) propyltrimethoxysilane
4-(2-aminoethylamine) butyltrimethoxysilane
4-(2-aminoethylamine) butyltriethoxysilane
12-(2-aminoethylamine) dodecyltriethoxysilane
12-(3-aminopropylamine) dodecyltriethoxysilane
18-(4-aminobutylamine) octadecyltriethoxysilane
3-triethoxysilane propylamine
3-trimethoxysilane propylamine
6-trimethoxysilane hexylamine
12-triethoxysilane dodecylamine
18-triethoxysilane octadecylamine In preferred embodiments of the invention, the alkoxysilane compound is applied to the aluminum surface from a 1% to 2% by volume toluene solution. Other solvents such as methylene chloride, chloroform, THF, acetonitrile, hexane, cyclohexane or other dry organic solvents can be used.

The baking temperatures during both baking steps are maintained between 25° C. and 120° C. The preferred range is from about 65° C. to about 100° C. The time of baking is usually from about 1 minute to about 5 minutes.

An aluminized mylar substrate used in this invention is from about 0.1 mil to 1 mil thick.

The coating steps of the invention can take the form of any of the well known coating techniques such as blading, dipping, spraying, silk screening and the like.

Now, the present invention is further illustrated by the following examples; it should be obvious, however, that the present invention is in no way limited thereto.

EXAMPLES

EXAMPLE 1

A commercially available aluminized mylar substrate is provided. The mylar provides the needed strength for the proposed resistive ribbons. It is flexible and not brittle as is required for its proposed use. The aluminum film serves as the conductive medium. To the aluminum surface is coated a thin layer of a bonding agent consisting of a 2% solution of 3(2-aminoethylamine) propyltrimethoxy silane in toluene. The so coated structure is then heated at a temperature of about 85° C. for approximately 4 minutes. Upon cooling a resistive coating composition consisting of 6.6 grams of a polycarbonate mixture comprising 75% polycarbonate and 25% graphite by weight in 150 ml of methylene chloride is knife coated onto the bonding composition. The resistive coating is about 12$\mu$ thick. The structure is again heated at about 85° C. and for about 4 minutes. An ink containing about 9.4 grams of Versamide 940 and 2.6 grams of carbon black is spray coated onto the opposing surface of the substrate. The structure is allowed to dry and is subsequently used as an electrothermal printing ribbon. The resistive layer was found to strongly adhere to the Al layer.

EXAMPLE 2

The method as described in Example 1 is used, except that the bonding composition is prepared from 3-(2-aminomethylamine) propyltrimethoxysilane.

EXAMPLES 3–10

The method as described in Examples 1 and 2 is used, except that the following compounds were used in this bonding composition.

4-(2-aminoethylamine) butyltrimethoxysilane
4-(2-aminoethylamine) butyltriethoxysilane
12-(2-aminoethylamine) dodecyltriethoxysilane
12-(3-aminopropylamine) dodecyltriethoxysilane
18-(4-aminobutylamine) octadecyltriethoxysilane
3-triethoxysilane propylamine
3-trimethoxysilane propylamine
6-trimethoxysilane hexylamine
12-triethoxysilane dodecylamine
18-triethoxysilane octadecylamine Equal results as in Examples 1 and 2 were obtained.

Having thus described our invention, what we claim as new, and desire to secure by Letters Patent is:

1. An improved resistive ribbon for electrothermal printing comprising, a substrate having at one of its surfaces an ink which when heated is transferable onto a printing surface;

a metal layer on the opposing surface of said substrate, a resistive composition layer atop said metal layer; and a bonding layer between said metal layer and said resistive layer to bond said metal and resistive layers together.

2. An improved resistive ribbon according to claim 1 wherein said bonding layer is comprised of an adhesion promoter selected from an amino-amine containing alkoxysilane having the following formulae:

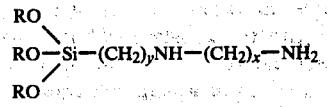

$$\begin{array}{l} RO \\ RO-Si-(CH_2)_yNH-(CH_2)_x-NH_2 \\ RO \end{array}$$

where R is selected from methyl and ethyl groups Y is 1 to 18 and X is 1 to 18, and $$(R-O)_3-Si-(CH_2)_n-NH_2$$

where R is an alkane group having from 1–5 C atoms and n is from 1–18.

3. An improved resistive ribbon according to claim 2 wherein said resistive layer is comprised of graphite filled polycarbonate and said conducting film is Al.

4. An improved resistive ribbon according to claim 2 wherein said adhesion promoter is selected from 3-(2-aminoethylamine) propyltrimethoxysilane, 3-(2-aminoethylamine) propyltrimethoxysilane and 3-(2-aminoethylamine) propyltriethoxysilane, 3-(2-aminoethylamine) propyltrimethoxysilane, 4-(2-aminoethylamine) butyltrimethoxysilane, 4-(2-aminoethylamine) butyltriethoxysilane, 12-(2-aminoethylamine) dodecyltriethoxylsilane, 12-(3-aminopropylamine) dodecyltriethoxysilane, 18-(4-aminobutylamine) octadecyltriethoxysilane, 3-triethoxysilane propylamine, 3-trimethoxysilane propylamine, 6-trimethoxysilane hexylamine, 12-triethoxysilane dodecylamine, 18-triethoxysilane octadecylamine.

5. A method for fabricating four layered resistive ribbons for electrothermal printing including the steps of:

(a) providing a substrate having a conducting film disposed on one of its surfaces;

(b) applying a thin layer of an alkoxysilane adhesion promoter to said conducting film having the following structures:

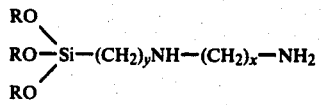

where R is $CH_3$ or $C_2H_5$, Y=1-18 and X is 1-18, and $$(R-O)_3-Si-(CH_2)_n-NH_2$$

where R is an alkane group having from 1-5 C atoms and n is from 1-18;

(c) heating said adhesion promoter coated substrate at a temperature and for a time sufficient to cause said adhesion promoter to adhere to said conducting film, (d) cooling the substrate and coating a resistive composition layer onto said adhesion promoter layer;

(e) again heating said so coated substrate for a time and at a temperature sufficient to cause said resistive composition layer to adhere to said adhesion promoter layer; and thereafter (f) coating on the other surface of said substrate an ink which is transferable onto a printing surface when electrothermally heated.

6. A method according to claim 5 wherein said conducting film is Al, said resistive composition is graphite filled polycarbonate and said adhesion promoter layer is selected from 3-(aminomethylamine) propylmethoxysilane, 3-(2-aminoethylamine) propyltrimethoxysilane and 3-(2-aminoethylamine) propyltriethoxysilane, 4-(2-aminoethylamine) butyltrimethoxysilane, 4-(2-aminoethylamine) butyltriethoxysilane, 12-(2-aminoethylamine) dodecyltriethoxysilane, 12-(3-aminopropylamine) dodecyltriethoxysilane, 18-(4-aminobutylamine) octadecyltriethoxysilane, 3-triethoxysilane propylamine, 3-trimethoxysilane propylamine, 6-trimethoxysilane hexylamine, 12-triethoxysilane dodecylamine, 18-triethoxysilane octadecylamine.

7. A method according to claim 5 wherein said heating steps are at a temperature in the range of 25° C. to about 120° C. and for about 1 to 5 minutes.

8. A method according to claim 5 wherein said heating steps are at a temperature in the range of about 65° C. to about 100° C.

* * * * *